US007972180B2

(12) United States Patent
Li et al.

(10) Patent No.: US 7,972,180 B2
(45) Date of Patent: Jul. 5, 2011

(54) ELECTRICAL CONNECTOR

(75) Inventors: Yao Li, Guangzhou (CN); Wu Feng, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/774,201

(22) Filed: May 5, 2010

(65) Prior Publication Data

US 2011/0124229 A1 May 26, 2011

(30) Foreign Application Priority Data

Nov. 26, 2009 (CN) ..... 2009 2 0263481 U

(51) Int. Cl.
*H01R 24/00* (2006.01)

(52) U.S. Cl. ..... 439/660

(58) Field of Classification Search ..... 439/660, 439/541.5, 79, 607.23–607.25
See application file for complete search history.

(56) References Cited

U.S. PATENT DOCUMENTS 6,945,796 B2 * 9/2005 Bassler et al. ..... 439/101
2002/0048999 A1 * 4/2002 Ming-Hui ..... 439/660
2005/0095915 A1 * 5/2005 Oleynick et al. ..... 439/607
2009/0042450 A1 * 2/2009 Zheng et al. ..... 439/660
2009/0042451 A1 * 2/2009 He et al. ..... 439/660
2009/0186528 A1 * 7/2009 Chen ..... 439/660

FOREIGN PATENT DOCUMENTS

CN 200820189094.1 8/2008

* cited by examiner

*Primary Examiner* — Renee Luebke
*Assistant Examiner* — Larisa Z Tsukerman
(74) *Attorney, Agent, or Firm* — Rosenberg, Klein & Lee

(57) ABSTRACT

An electrical connector includes an insulating body having an accommodating base and at least one tongue plate extending forwardly from the accommodating base. The tongue plate has at least one accommodating space in communication with the accommodating base. Each accommodating space being provided with at least one stopper. At least one first conductive terminal and at least one second conductive terminal are received in the accommodating base. The second conductive terminal has a second connecting portion and a second contacting portion extending towards the accommodating space. The first conductive terminal is partially located below the second connecting portion, and has at least a portion extended under the stopper. The second connecting portion is located at a level higher than that of the stopper. This arrangement can prevent the first conductive terminal from contacting with the second conductive terminal, and a normal connection of the electrical connector is guaranteed.

11 Claims, 7 Drawing Sheets

ELECTRICAL CONNECTOR

BACKGROUND OF THE INVENTION

1. Field of the Invention

The present invention relates to an electrical connector, and in particular to an electrical connector with a high speed of transmitting signals.

2. Description of Related Art

Universal Series Bus (referred to as USB hereinafter) interface is a standard input/output interface, and it is widely used in various electronic apparatuses. Until now, three versions of USB interfaces including USB1.0, USB1.1 and USB2.0 have been developed.

The above-mentioned three versions of USB (USB1.0, USB1.1 and USB2.0) are respectively configured to support three levels of transmitting speed: (1) low-speed mode having a transmitting speed of 1.5 Mbps, often used in keyboards and mice; (2) full-speed mode having a transmitting speed of 12 Mbps; and (3) high-speed mode having a transmitting speed of 480 Mbps.

However, with the development of electronic industry, the transmitting speed achieved by the USB 2.0 has become unable to satisfy the requirements for some high-level electronic industries. Thus, a newly-developed connector (USB3.0) is developed. According to the standard of USB3.0, two sets of differential terminals and a grounding terminal are added on the basis of four terminals of USB2.0. Thus, there are nine terminals in total, which makes the transmitting speed up to 5 G bps. In the USB3.0, five additional terminals and the four original terminals are provided on the same side surface of a tongue plate of an electrical connector. Because the positions of the terminals are uniformed, the upper row of five terminals partially overlaps the lower row of four terminals in the vertical direction, and these two rows of terminals are not brought into contact with each other. In such a small-sized tongue plate, the aforesaid standard arrangement of terminals may make it more difficult to manufacture. In order to solve this problem, a solution is proposed by the industry in this art, in which five additional terminals are embedded in the tongue plate during the formation of the tongue plate. The tongue plate is provided with accommodating troughs for accommodating the above-mentioned four terminals. In this way, nine terminals can be totally provided in one side surface of the tongue plate. However, the above solution of embedding terminals in the tongue plate needs complicated operations. Thus, the industry in this art proposed another solution, in which it is not necessary to embed five terminals during the formation of the tongue plate. For example, China Patent No. CN200820189094.1 discloses an USB3.0 connector, which includes: an insulating body having at least one tongue plate, the tongue plate being provided therein with a plurality of first accommodating troughs and second accommodating troughs, the first accommodating troughs being located below the second accommodating troughs and in communication with the second accommodating troughs, the tongue plate being provided with a space above the second accommodating trough; a plurality of first terminals with their front ends extending to form first main bodies received in the first accommodating troughs respectively; a plurality of second terminals with their front ends extending to form second main bodies, the second main bodies being received in the second accommodating troughs and located above the first main bodies respectively.

Although the above-mentioned electrical connector is provided with the first accommodating troughs and the second accommodating troughs for receiving the first terminals and the second terminals respectively so as to simplify the manufacture of the electrical connector, there is still a problem as follows: Since the first accommodating troughs are in communication with the second accommodating troughs, when the first terminals are subjected to an excessive force due to an improper operation, the first terminals may be forced to move upwards to such an extent that the first terminals are brought into contact with the second terminals.

Therefore, it is necessary to propose a novel electrical connector to overcome the above-mentioned problems.

SUMMARY OF THE INVENTION

In view of the problems encountered in prior art, an objective of the present invention is to provide an electrical connector, which can be manufactured easily with a compact structure and protect the terminals from contacting with each other.

To achieve the above objective, the present invention provides an electrical connector, which includes: an insulating body having an accommodating base and a tongue plate extending forwardly from the accommodating base, the tongue plate being provided therein with at least one accommodating space in communication with the accommodating base, each of the accommodating spaces being provided therein with at least one stopper; at least one first conductive terminal and at least one second conductive terminal received in the accommodating base, the second conductive terminal extending towards the accommodating space to form a second connecting portion and a second contacting portion, the first conductive terminal received in the accommodating space being partially located below the second connecting portion, at least a portion of the first conductive terminal extending to the underside of the stopper, the second connecting portion received in the accommodating space being located at a level higher than that of the stopper.

In comparison with prior art, the electrical connector of the present invention has advantageous features as follows. Since the tongue plate is provided with the accommodating space in which at least one stopper is received, the stopper cooperates with the terminals to protect the first conductive terminals from contacting with the second conductive terminals, thereby guaranteeing a normal connection of the electrical connection.

In order to make the Examiner to further understand the objectives, shape, construction, characteristics and functions of the present invention, a description relating thereto will be made with reference to the accompanying drawings.

DETAILED DESCRIPTION OF THE PREFERRED EMBODIMENTS

Figure 1:
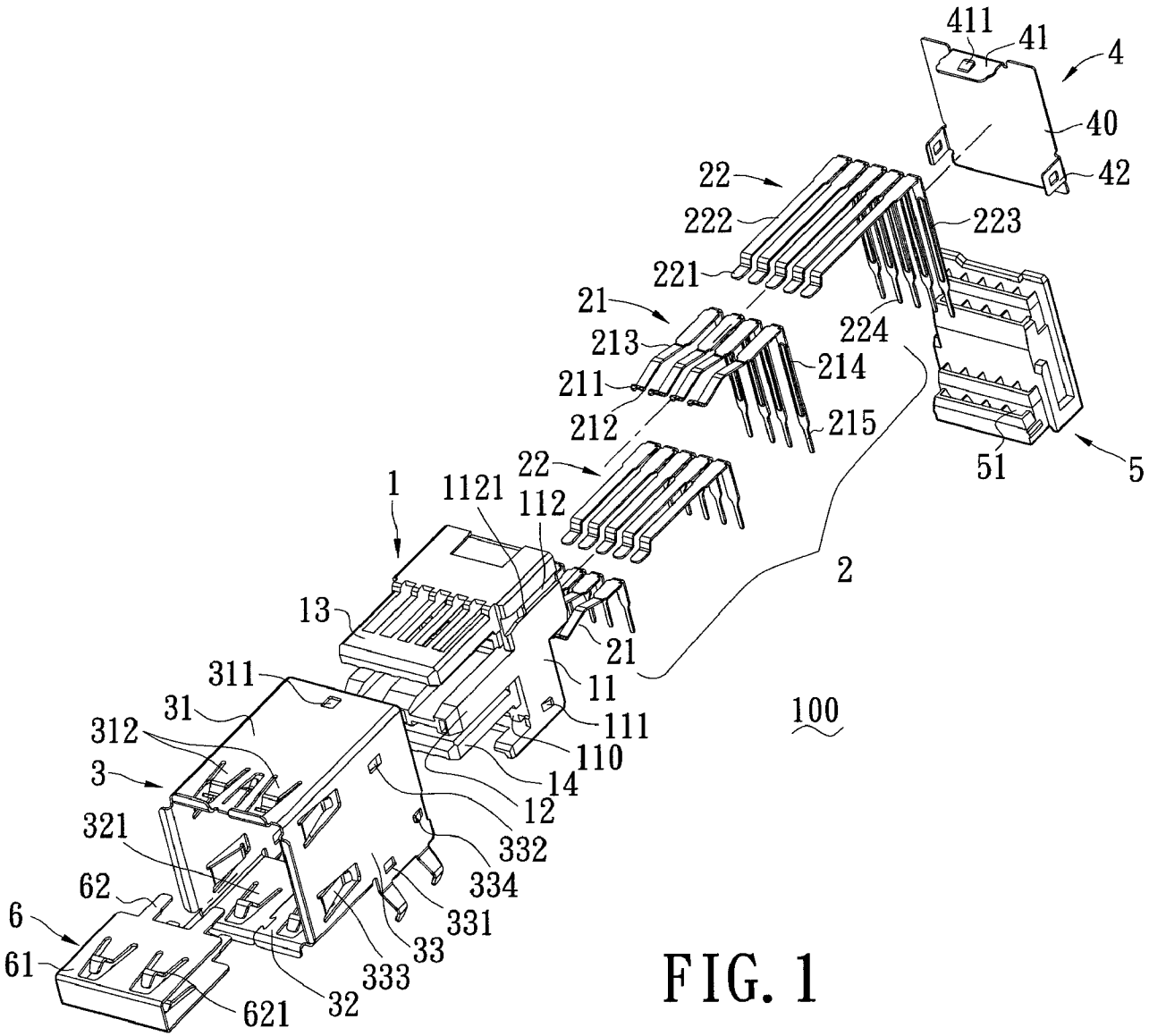
FIG. 1 is an exploded perspective view showing an electrical connector of the present invention.
Figure 2:
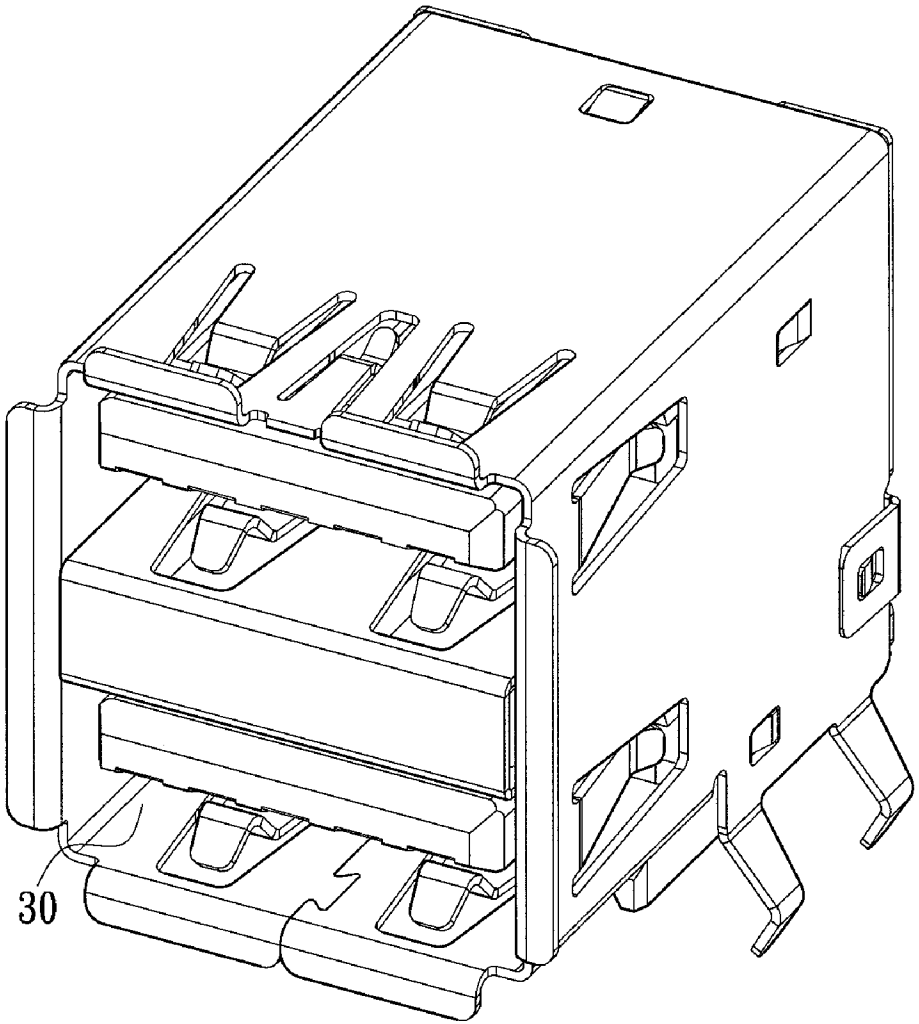
FIG. 2 is an assembled perspective view showing the electrical connector of the present invention.
Figure 3:
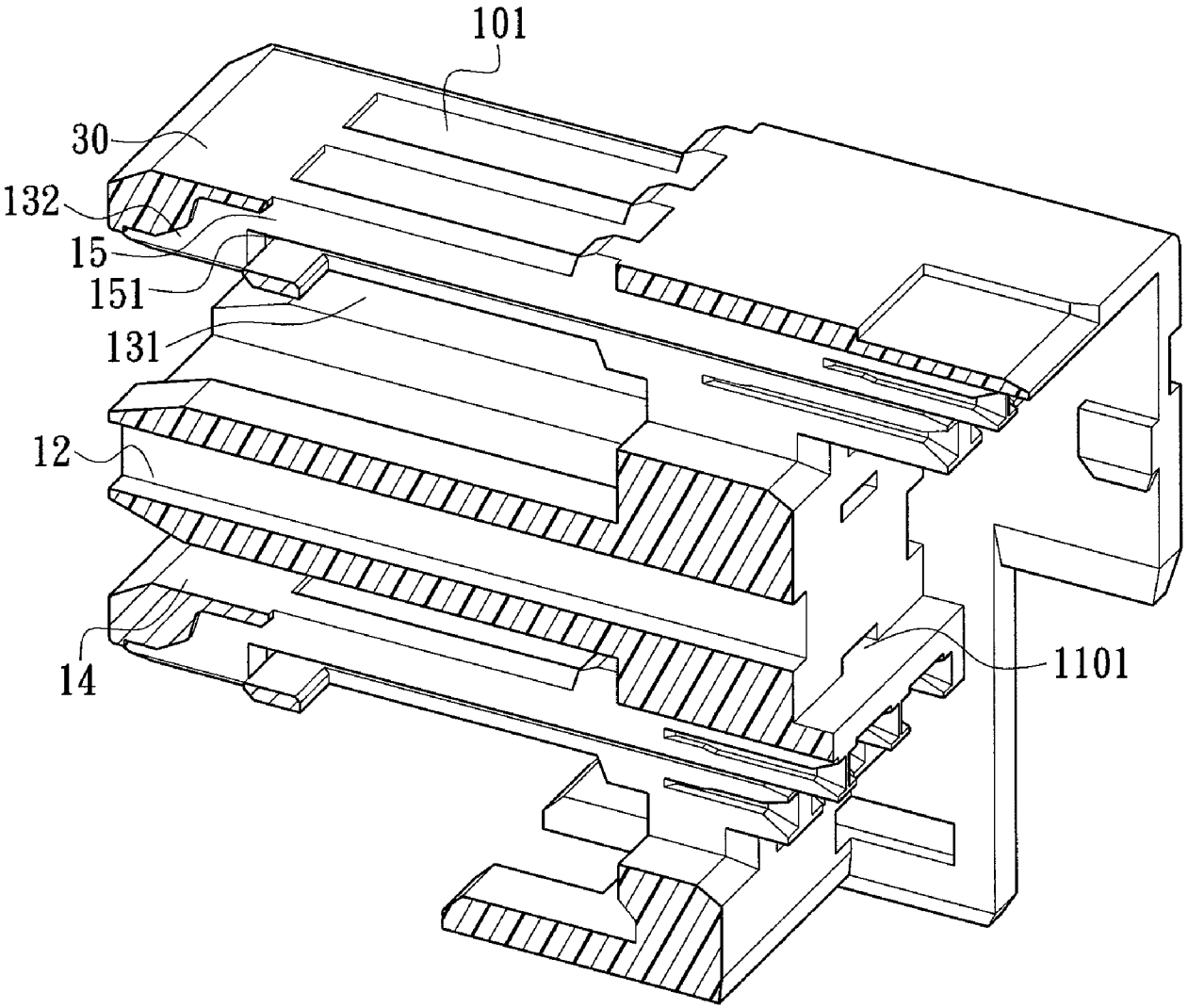
FIG. 3 is a cross-sectional view showing an insulating body in the electrical connector of the present invention.

An electrical connector according to the present invention will be further explained with reference to the accompanying figures and an embodiment thereof.

Please refer to FIGS. 1 to 8. The electrical connector 100 of the present invention can be soldered onto a circuit board (not shown). The electrical connector 100 includes an insulating body 1, a plurality of conductive terminals 2 held in the insulating body 1, a shielding casing 3 covering the periphery of the insulating body 1, a metallic rear cover 4, a terminal holder 5, and a U-shape metallic shroud 6.

The insulating body 1 includes an accommodating base 11, a partitioning plate 12 protruding forwardly from a front surface 110 of the accommodating base 11, an upper tongue plate 13 and a lower tongue plate 14 both protruding forwardly from the front surface 110 of the accommodating base 11 respectively, at least one rib 15 provided in the upper tongue plate 13 and the lower tongue plate 14, and at least one accommodating space 10 in communication with the accommodating base 11, the upper tongue plate 13 and the lower tongue plate 14.

Figure 5:
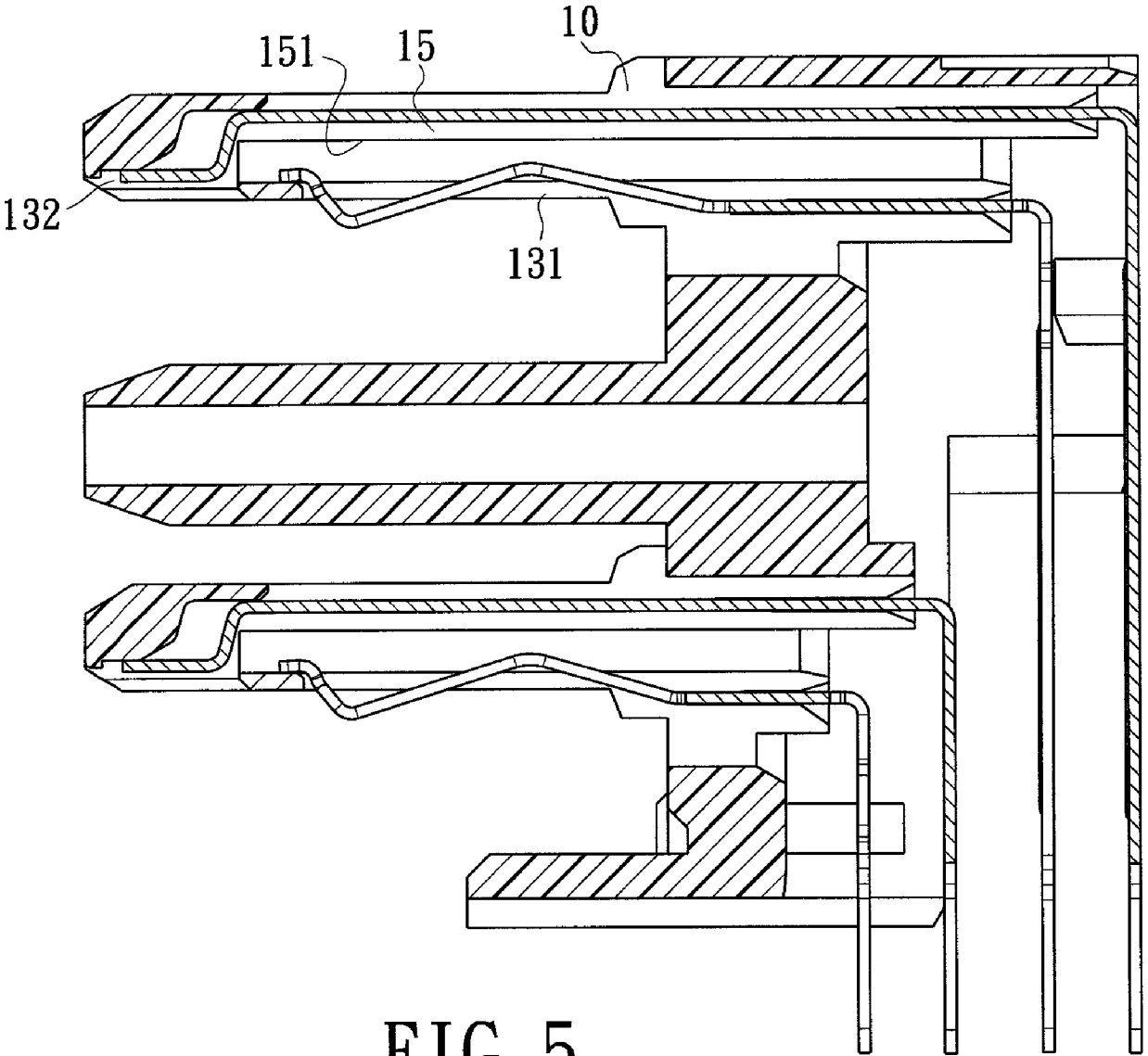
FIG. 5 is a front view of FIG. 4.
Figure 6:
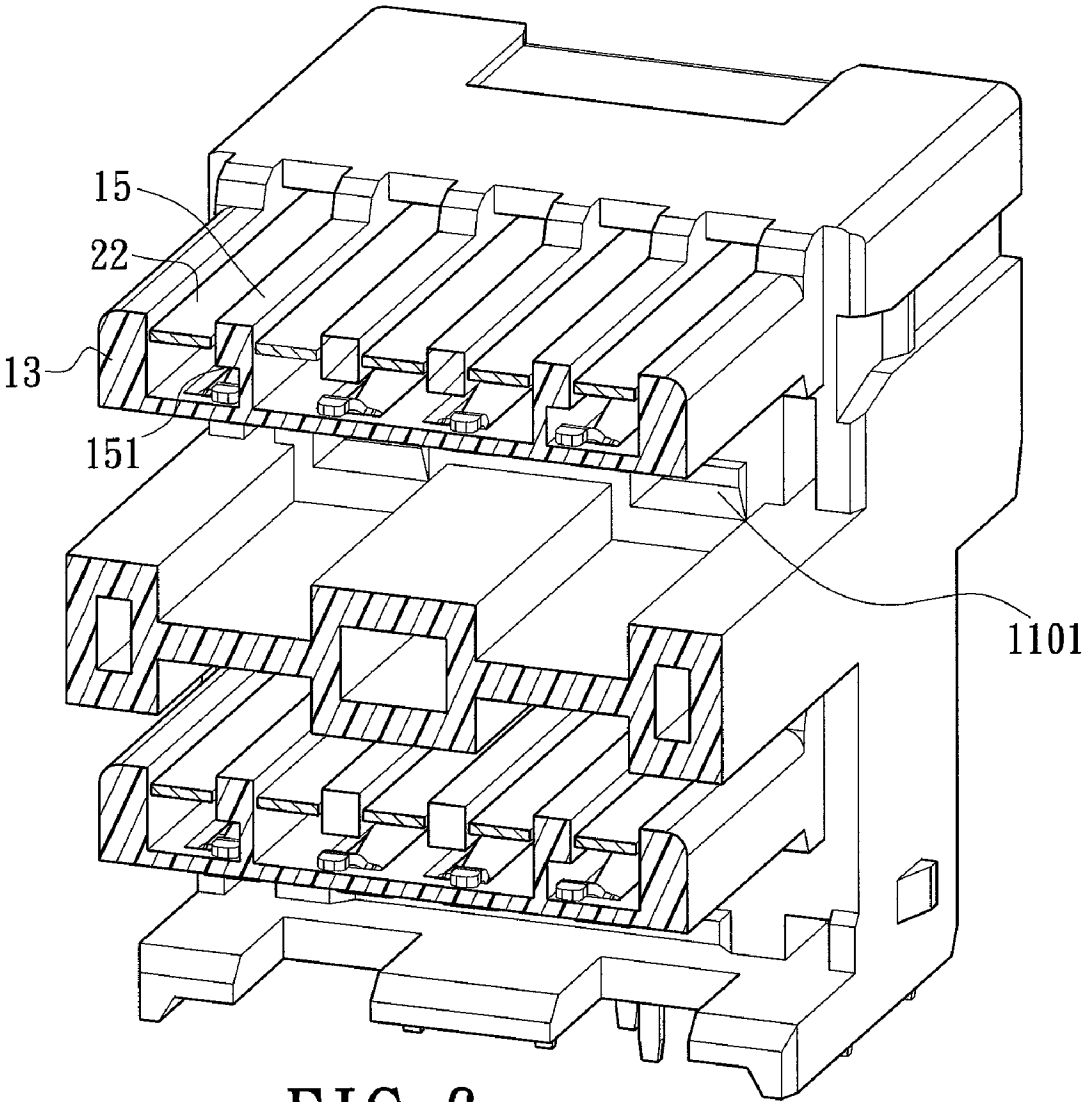
FIG. 6 is a cross-sectional view taken from another viewing angle showing that the insulating body is assembled with the terminals in the electrical connector of the present invention.

The upper tongue plate 13 and the lower tongue plate 14 are formed by extending forwardly from the front surface 110 of the accommodating base 11. The interiors of the upper tongue plate 13 and the lower tongue plate 14 are formed with at least one accommodating space 10 respectively in communication with the accommodating base 11. The at least one rib 15 extends in the accommodating space 10 from the front surface 110 of the accommodating base 11 in the extending direction of the upper tongue plate 13 and the lower tongue plate 14. In the present embodiment as shown in FIGS. 5 and 6, there are more than two ribs 15. At least one accommodating trough 101 is formed between each two of the ribs 15. Each of the ribs 15 is of a certain thickness and its lower surface is formed with a stopper 151. Further, the lower surfaces of the upper tongue plate 13 and the lower tongue plate 14 are provided with at least one first slot 131 and at least one second slot 132 respectively. Two rows of the first slots 131 and the second slots 132 are formed in the extending direction of the upper tongue plate 13 and the lower tongue plate 14 respectively. The first slots 131 are located closer to the front surface 110 of the accommodating base 11 than the second slots 132.

Figure 8:
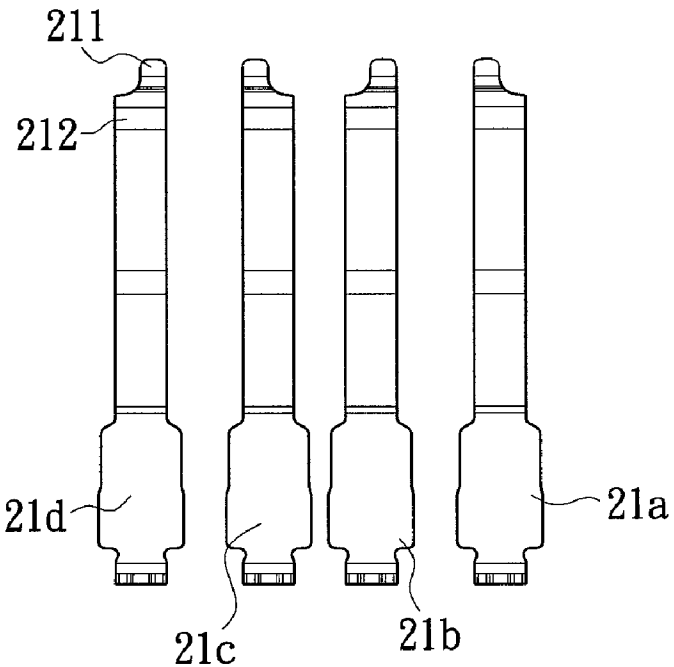
FIG. 8 is a schematic view showing first conductive terminals in the electrical connector of the present invention.

Please refer to FIGS. 1 and 8. The conductive terminals 2 include a plurality of first conductive terminals 21 and a plurality of second conductive terminals 22. Each first conductive terminal 21 includes a first contacting portion 212, a first buckling portion 211 bent and extending forwardly from the first contacting portion 212, a first connecting portion 213 bent and extending rearward from the first contacting portion 212, a first mounting portion 214 bent and extending from a rear end of the first connecting portion 213, and a first soldering portion 215 extending rearward from the first mounting portion 214. Each of the first conductive terminals 21 is of the same shape. As shown in FIG. 8, using the central line of each first conductive terminal 21 as a datum line, the distance between the first piece of terminal 21*a* and the second piece of terminal 21*b* of the first conductive terminal 21 is 2.5 mm. The distance between the third piece of terminal 21*c* and the second piece of terminal 21*b* is 2.0 mm. The distance between the fourth piece of terminal 21*d* and the third piece of terminal 21*c* is 2.5 mm.

Figure 7:
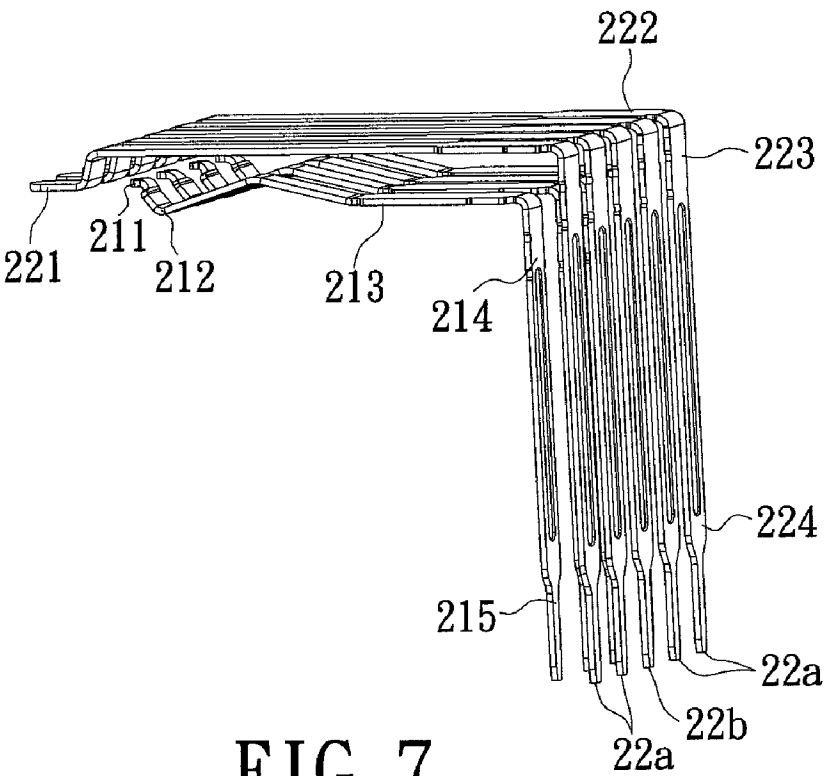
FIG. 7 is a schematic view showing second conductive terminals in the electrical connector of the present invention.

Please refer to FIGS. 1 and 7. The second conductive terminals 22 include two pairs of differential signal terminals 22*a* and a grounding terminal 22*b*. One pair of the differential signal terminals 22*a* is configured to output signals at a high speed, and the other pair of the differential signal terminals 22*a* is configured to receive signals at a high speed. The grounding terminal 22*b* is located between the two pairs of the differential signal terminals 22*a* for reducing the crosstalk generated by the differential signal terminals 22*a* in transmitting signals. Each second conductive terminal 22 includes a second contacting portion 221, a second connecting portion 222 bent and extending rearward from the second contacting portion 221, a second mounting portion 223 bent and extending from the second connecting portion 222, and a second soldering portion 224 bent and extending rearward from the second mounting portion 223. The second contacting portion 221 is shaped as an elongated flat plate in parallel to the upper surfaces of the upper tongue plate 13 and the lower tongue plate 14. Each of the second conductive terminals 22 is of the same shape. Using the central line of each second conductive terminal 22 as a datum line, the distance between two neighboring terminals of the second conductive terminals 22 is 2.0 mm.

Figure 4:
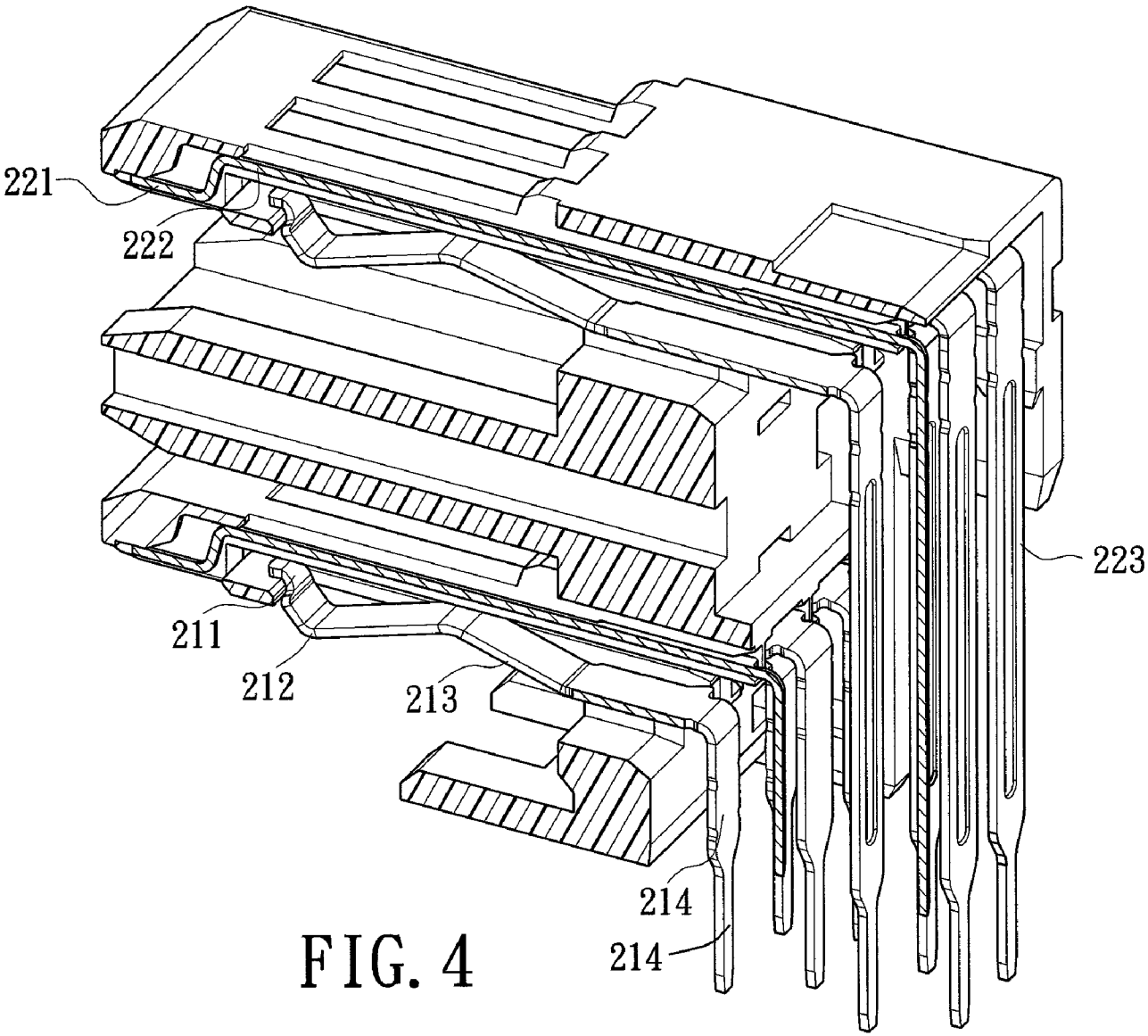
FIG. 4 is a perspective view showing that terminals are mounted in the insulating body of FIG. 3.

Please refer to FIGS. 3 to 6. The first conductive terminal 21 extends from the accommodating base 11 towards the accommodating space 10 in the upper tongue plate 13 and the lower tongue plate 14 to successively form the first connecting portion 213, the first contacting portion 212 and the first buckling portion 211. A part of the first contacting portion 212 protrudes outside the underside of the first slot 131. The first connecting portion 213 is received in the first slot 131. The first buckling portion 211 is buckled to the edge of the first slot 131. The second conductive terminal 22 extends from the accommodating base 11 towards the accommodating space 10 in the upper tongue plate 13 and the lower tongue plate 14 to successively form the second connecting portion 222 and the second contacting portion 221. The second contacting portion 221 is received in the second slot 132. The second connecting portion 222 is received in the accommodating trough 101 formed between the two ribs 15. However, according to the above-mentioned relationship of the distance between the conductive terminals 2, the first conductive terminal 21 is partially located below the second conductive terminal 22 in the vertical direction. As shown in FIGS. 4 and 5, after the first conductive terminal 21 is raised, the front end of the first conductive terminal 21 will move upward in circling way by utilizing the bending point of the first mounting portion 214 as the center of a circle, and utilizing the distance from the bending point as a radius. With reference to the drawings, it is estimated that, the first buckling portion 211 at the front end of the first conductive terminal 21 is raised higher than other portions of the first conductive terminal 21. Thus, in order to prevent the first conductive terminal 21 from contacting the second conductive terminal 22, it is very important to prevent the first buckling portion 211 at the front end of the first conductive terminal 21 from being raised excessively. To solve this problem, as shown in FIG. 6, according to the present invention, the rib 15 extends from the accommodating base 11 towards the accommodating space 10 in the extending direction of the upper tongue plate 13 and the lower tongue plate 14. The lower surface of the rib 15 is formed with a stopper 151. The stopper 151 is located at a level lower than that of the second connecting portion 222. A part of the first conductive terminal 21 is located below the stopper 151. The portion of the first conductive terminal 21 located below the stopper 151 includes the first buckling portion 211. The first buckling portion 211 is located at the front end of the first conductive terminal 21 and extends from the first contacting portion 212.

Concerning the characteristic of the prevent invention, the front end of the first conductive terminal 21 is disposed under the stopper 151, an alternative embodiment would be provided in the present invention. The stopper 151 may be configured to act as a fulcrum. Further, the front end of the first conductive terminal 21 is provided below the fulcrum. Such an arrangement can also protect the terminals 2 from contacting with each other.

Please refer to FIGS. 1 to 8. The metallic rear cover 4 has a rectangular main plate 40, at least one metallic tab 42 extending from both sides of the main plate 40, and an auxiliary fastener 41 bent and extending from an upper edge of the main plate 40. The metallic tab 42 is provided with a locking hole 421. The auxiliary fastener 41 has a protrusion elastic piece 411 protruded upwardly.

The terminal holder 5 is configured to fix the terminals 2. The terminal holder 5 is provided with holding troughs 51 for fixing the terminals 2. The holding troughs 51 are arranged in a stepped manner.

The shielding casing 3 is made by stamping a metallic sheet, and includes an upper surface 31, a lower surface 32 and two side surfaces 33. The shielding casing 3 is mounted on the accommodating base 11 of the insulating body 1 and located in the periphery of the upper tongue plate 13 and the lower tongue plate 14 to form a chamber 30. The upper surface 31 has a through hole 311 mating with the protrusion elastic piece 411 of the metallic rear cover 4. The upper surface 31 has at least one first abutting piece 312. The two side surfaces 33 are respectively provided with a hole 331 mating with a protrusion 111 formed on the accommodating base 11. The two side surfaces 33 are respectively provided with an elastic piece 332 for mating with a transverse bump 1121 on the accommodating base 11. Both side surfaces 33 are respectively provided with at least one second abutting piece 333, and an abutting piece 334 for mating with the metallic tab 42 on the metallic rear cover 4. The lower surface 32 is provided with at least one third abutting piece 321.

Please refer to FIGS. 1 and 6. The U-shape metallic shroud 6 includes a U-shape shell 61 and at least one plate-like pin 62. The upper surface and the lower surface of the U-shape shell 61 are respectively provided with at least one fourth abutting piece 621. The plate-like pin 62 is mated with the insertion hole 1101 of the insulating body 1, thereby mounting the partitioning plate 12 into a U-shape space.

The electrical connector 100 is compatible with the existing USB electrical connector. That is, a plug for the existing USB 2.0 connector can be inserted into the electrical connector 100 for transmitting data. Thus, the dimension of the upper tongue plate 13 is substantially identical to that of the tongue plate of the USB 2.0 connector with an acceptable tolerance.

According to the above, the electrical connector of the present invention has advantageous features as follows. The accommodating space 10 provided on the upper tongue plate 13 and the lower tongue plate 14 is in communication with the accommodating base 11. The upper tongue plate 13 and the lower tongue plate 14 are integrally formed with the accommodating base 11. In assembly, the first conductive terminal 21 extends toward the accommodating space 10 in the upper tongue plate 13 and the lower tongue plate 14 to successively form the first connecting portion 213, the first contacting portion 212 and the first buckling portion 211. The second conductive terminal 22 extends toward the accommodating space 10 in the upper tongue plate 13 and the lower tongue plate 14 to successively form the second connecting portion 222 and the second buckling portion 221. The stopper 151 is formed in the accommodating space 10. The first conductive terminal 21 is partially provided below the stopper 151. However, in order to make the stopper 151 to prevent the first conductive terminal 21 from being raised excessively to contact with the second conductive terminal 22, according to the present invention, the first buckling portion 211 located at the front end of the first conductive terminal 21 is provided under the stopper 151. Thus, the manufacturing process can be simplified and the operation thereof is easy.

The above-mentioned descriptions represent merely the preferred embodiments of the present invention, without any intention to limit the scope of the present invention thereto. Various equivalent changes, alternations or modifications based on the claims of present invention are all consequently viewed as being embraced by the scope of the present invention.

What is claimed is:

1. An electrical connector, including:

an insulating body having an accommodating base and a tongue plate extending forwardly from the accommodating base, the tongue plate having a plurality of accommodating spaces formed therein being in communication with the accommodating base and at least one stopper formed in each accommodating space respectively;

a plurality of first conductive terminals and a plurality of second conductive terminals received in the accommodating base, wherein each of the second conductive terminals has a second connecting portion and a second contacting portion extending towards the accommodating spaces correspondingly, wherein each of the first conductive terminals received in the accommodating space being partially located below the second connecting portion, wherein each first conductive terminal has a portion extending to a underside of the stopper, each of the second connecting portions correspondingly received in the accommodating space being located at a level higher than that of the stoppers;

wherein each of the first conductive terminals has a first contacting portion and a first buckling portion extending from the first contacting portion, the first contacting portions and the second contacting portions are arranged in two rows and extending in a direction of the tongue plate and are exposed to one side of the tongue plate, the first buckling portions are located below the stoppers.

2. The electrical connector according to claim 1, wherein a cross-sectional area of the first buckling portion is smaller than that of the first contacting portion.

3. The electrical connector according to claim 1, wherein the first contacting portion is elastic.

4. The electrical connector according to claim 3, wherein the first contacting portion is located closer to the accommodating base than the second contacting portion.

5. The electrical connector according to claim 1, wherein the first contacting portion and the second contacting portion are not located in the same plane.

6. The electrical connector according to claim 1, wherein the insulating body has at least one rib extending towards the accommodating space, the stopper is formed on a lower surface of the rib.

7. The electrical connector according to claim 6, wherein the second conductive terminal is located in a space formed between two of the ribs.

8. The electrical connector according to claim 1, wherein the second connecting portion of the second conductive terminal is shaped as a flat plate.

9. The electrical connector according to claim 8, wherein the second connecting portion is in parallel to an upper surface of the tongue plate.

10. An electrical connector, including:

an insulating body having an accommodating base and a tongue plate extending forwardly from the accommodating base, wherein the tongue plate has a plurality of accommodating spaces formed therein being in communication with the accommodating base and at least one stopper formed in each accommodating space respectively, wherein the insulating body has a plurality of ribs extending toward the accommodating spaces and the stoppers are formed on the lower surface of the ribs correspondingly; and a plurality of first conductive terminals and a plurality of second conductive terminals received in the accommodating base, wherein each of the second conductive terminals has a second connecting portion and a second contacting portion extending towards the accommodating spaces correspondingly, each of the first conductive terminals received in the accommodating space being partially located below the second connecting portion, and each first conductive terminal has a portion extending to a underside of the stopper, each of the second connecting portions correspondingly received in the accommodating space being located at a level higher than that of the stoppers.

11. The electrical connector according to claim 10, wherein each second conductive terminal is located in a space formed between two of the ribs.

* * * * *